US011413873B2

(12) United States Patent
Murakami

(10) Patent No.: US 11,413,873 B2
(45) Date of Patent: Aug. 16, 2022

(54) LIQUID CONSUMING DEVICE

(71) Applicant: CANON KABUSHIKI KAISHA, Tokyo (JP)

(72) Inventor: Ryotaro Murakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/161,563

(22) Filed: Jan. 28, 2021

(65) Prior Publication Data

US 2021/0245515 A1 Aug. 12, 2021

(30) Foreign Application Priority Data

Feb. 10, 2020 (JP) ..... JP2020-020500

(51) Int. Cl.
*B41J 2/185* (2006.01)
*B41J 2/165* (2006.01)
*B41J 2/17* (2006.01)

(52) U.S. Cl.
CPC ..... *B41J 2/16517* (2013.01); *B41J 2/1721* (2013.01); *B41J 2/185* (2013.01); *B41J 2002/1856* (2013.01)

(58) Field of Classification Search
CPC .. B41J 2/1721; B41J 2/185; B41J 2002/1856; B41J 2002/1728
See application file for complete search history.

(56) References Cited

U.S. PATENT DOCUMENTS 7,316,467 B2 * 1/2008 Toki ..... B41J 2/185 347/31
2007/0076046 A1 * 4/2007 Toki ..... B41J 2/185 347/31
2017/0120597 A1 * 5/2017 Nishikawa ..... B41J 2/16508

FOREIGN PATENT DOCUMENTS

JP 6036285 B2 * 11/2016
JP 2017-081094 5/2017

* cited by examiner

*Primary Examiner* — Sharon Polk
(74) *Attorney, Agent, or Firm* — Venable LLP

(57) ABSTRACT

To provide a liquid consuming device capable of causing liquid to flow smoothly and reducing contamination of the device and its surroundings, a first absorbent provided in a fixed waste liquid storage unit is connected to a second absorbent provided in a movable waste liquid storage unit by mating of a recessed portion with a protruding portion at the connecting portion between the first absorbent and the second absorbent.

12 Claims, 6 Drawing Sheets

LIQUID CONSUMING DEVICE

BACKGROUND OF THE INVENTION

Field of the Invention

The present invention relates to a liquid consuming device which discharges liquid from a liquid discharging unit and consumes the liquid, especially a liquid consuming device which stores the discharged liquid in a storage unit.

Description of the Related Art

Japanese Patent Laid-Open No. 2017-081094 discloses a liquid consuming device which stores, in waste liquid storage units, liquid sucked from a liquid consuming unit. The waste liquid storage units are classified into a fixed waste liquid storage unit that is fixed to the liquid consuming device and a movable waste liquid storage unit that can be detached from the liquid consuming device. Each of the fixed waste liquid storage unit and the movable waste liquid storage unit has an absorbent therein. A tip of the fixed side absorbent protruding from the fixed waste liquid storage unit is pressed against a planar portion of the movable side absorbent provided in the movable waste liquid storage unit, whereby liquid flows from the fixed waste liquid storage unit to the movable waste liquid storage unit.

In the case of causing liquid to flow, it is generally required that a large amount of liquid flow in a short time. In the case of causing liquid to flow by bringing absorbents into contact with each other, the amount of liquid flow depends on a contact area between the absorbents.

Since a liquid leakage tends to occur at the connecting portion between the fixed waste liquid storage unit and the movable waste liquid storage unit, the openings of the units are difficult to expand and the connection needs to be made in a limited area. In the case of causing a large amount of liquid to flow in a short time according to the method disclosed in Japanese Patent Laid-Open No. 2017-081094, it is considered that the contact area is increased. However, the method of simply increasing the contact area may cause a liquid leakage.

In the method of pressing a tip of one absorbent against a planar portion of the other absorbent as in Japanese Patent Laid-Open No. 2017-081094, the contact area between the absorbents in a limited area is further limited to the planar portion area of the other absorbent in contact with the tip of one absorbent or a deformable area of the planar portion.

As described above, in a case where the openings are difficult to expand and the connection is limited to the planar portion area of the absorbent or the deformable area of the planar portion, it often takes time to cause liquid to flow, which may inhibit a smooth flow of liquid. Further, there is a possibility that liquid overflows from the waste liquid storage units to the outside of the device and contaminates the device and its surroundings.

SUMMARY OF THE INVENTION

Thus, the present invention provides a liquid consuming device which enables a smooth flow of liquid.

Accordingly, a liquid consuming device of the present invention comprises: a consuming unit configured to consume liquid: and a storage unit configured to store liquid discharged from the consuming unit, the storage unit comprising a first storage unit comprising a first absorbent therein and a second storage unit comprising a second absorbent therein, liquid moving from the first storage unit to the second storage unit, wherein the first absorbent and the second absorbent are connected to each other by mating of a protruding portion provided in the first absorbent with a recessed portion provided in the second absorbent or mating of a recessed portion provided in the first absorbent with a protruding portion provided in the second absorbent.

According to the present invention, a liquid consuming device which enables a smooth flow of liquid can be provided.

Further features of the present invention will become apparent from the following description of exemplary embodiments with reference to the attached drawings.

DESCRIPTION OF THE EMBODIMENTS

First Embodiment

The first embodiment of the present invention will be described below with reference to the accompanying drawings.

Figure 1:
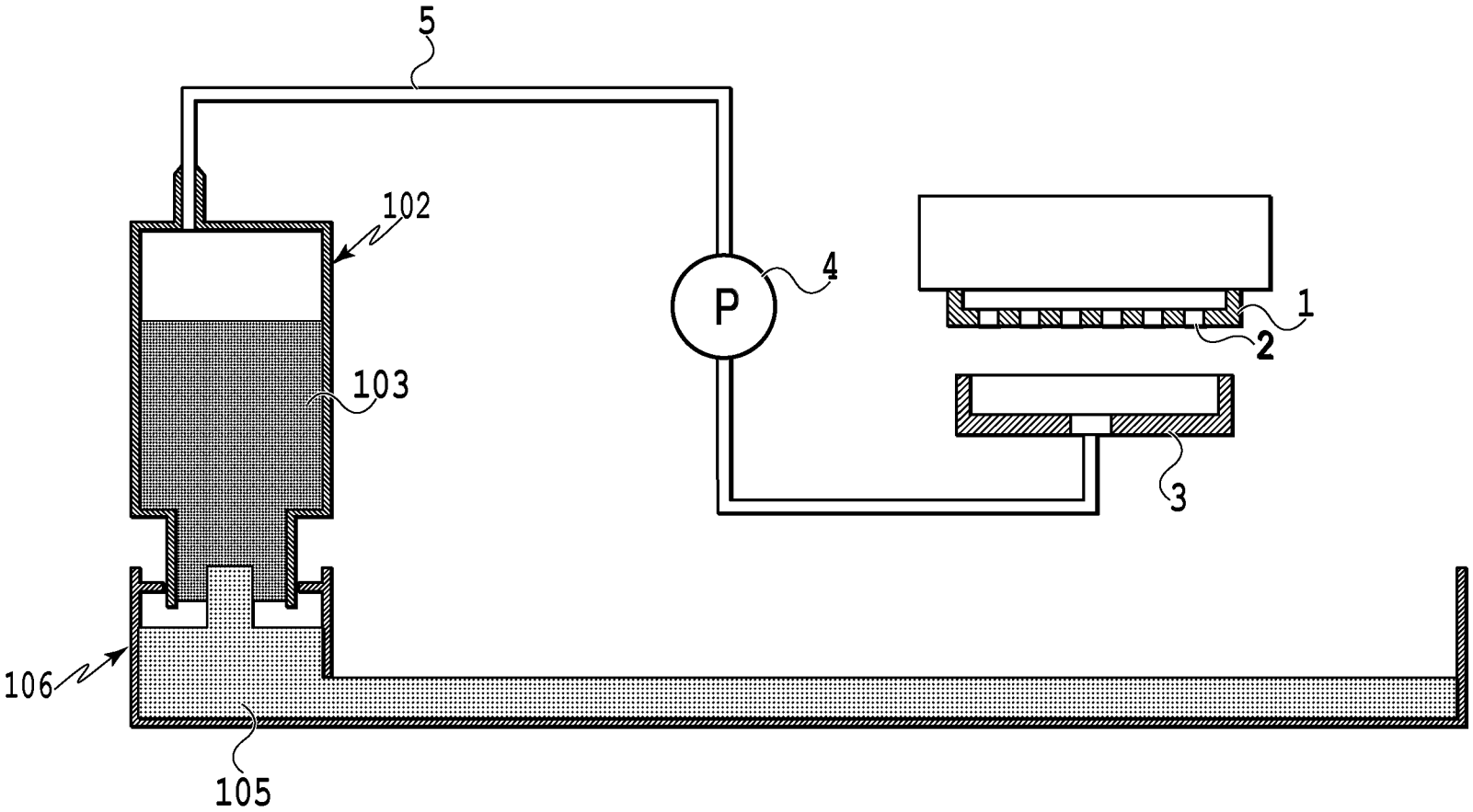
FIG. 1 is a diagram showing a main part of a liquid consuming device.

FIG. 1 is a diagram showing a main part of a liquid consuming device of the present embodiment. The liquid consuming device comprises an ejection head 1 which ejects liquid from an ejection port 2, a cap 3 capable of covering the ejection port 2 and sucking liquid from the ejection port 2, and a pump 4 connected to the cap 3 and capable of producing a negative pressure in an internal space of the cap 3 created by covering the ejection port 2 with the cap 3. The liquid consuming device further comprises a fixed waste liquid storage unit 102 connected to the pump 4 and the cap 3 through a tube 5 and a movable waste liquid storage unit 106 capable of receiving liquid from the fixed waste liquid storage unit 102.

The fixed waste liquid storage unit 102 is fixed to the body of the device and comprises a first absorbent 103 capable of absorbing liquid therein. The movable waste liquid storage unit 106 is detachably provided in the body of the device and comprises a second absorbent 105 capable of absorbing liquid therein. The first absorbent 103 and the second absorbent 105 are in contact with each other and liquid is supplied from the first absorbent 103 to the second absorbent 105 through the contact portion.

The pump 4 is driven with the ejection port 2 covered with the cap 3 and a negative pressure is thus produced in the internal space of the cap 3, whereby liquid is sucked from the ejection port 2. The sucked liquid enters the fixed waste liquid storage unit 102 from the cap 3 through the tube 5 and is absorbed by the first absorbent 103 in the fixed waste liquid storage unit 102. The liquid absorbed by the first absorbent 103 is then absorbed by the second absorbent 105 through the connecting portion between the first absorbent 103 and the second absorbent 105 and stored in the fixed waste liquid storage unit 102.

Figure 2B:
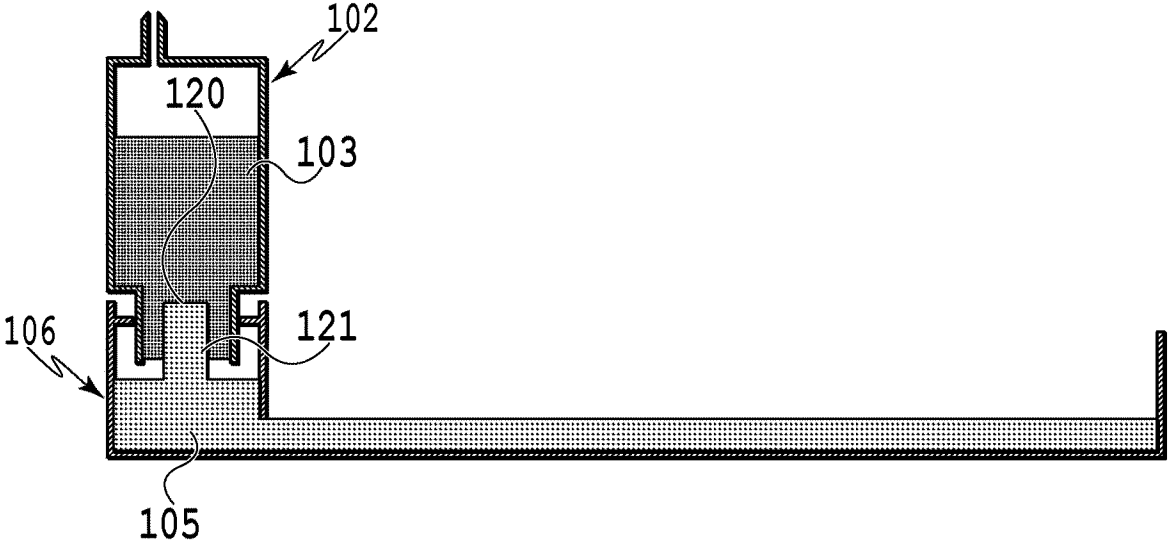
FIG. 2B is a diagram showing the connecting portion between the first absorbent and the second absorbent.
Figure 2A:
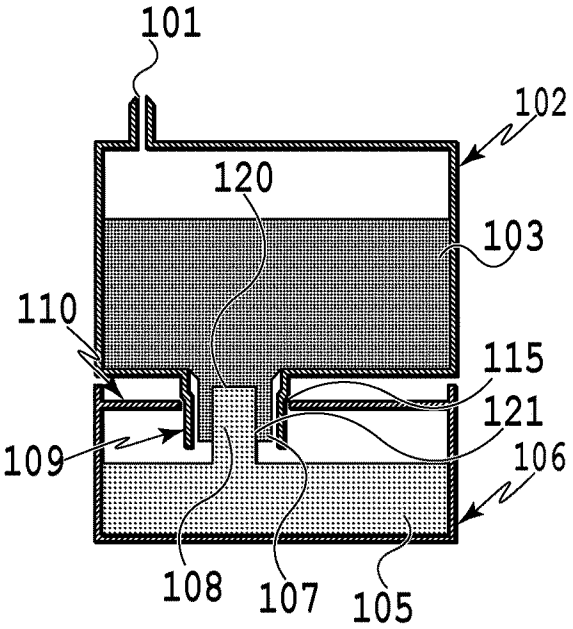
FIG. 2A is a diagram showing a connecting portion between a first absorbent and a second absorbent.

FIG. 2A and FIG. 2B are diagrams showing the connecting portion between the first absorbent 103 and the second absorbent 105 in the present embodiment. FIG. 2A is a side view and FIG. 2B is a front view. The fixed waste liquid storage unit 102 has an opening 109. The first absorbent 103 of the fixed waste liquid storage unit 102 extends up to the edge of the opening 109 and has a recessed portion 107 at the edge of the opening 109. For example, the recessed portion 107 has a shape of a hollow cylinder. The movable waste liquid storage unit 106 has an opening 115. The second absorbent 105 of the movable waste liquid storage unit 106 has a protruding portion 108 and is provided such that the protruding portion 108 protrudes from the opening 115. The protruding portion 108 protrudes from the opening 115 but is accommodated in the housing of the movable waste liquid storage unit 106 without protruding from the housing. For example, the protruding portion 108 has a cylindrical shape. The fixed waste liquid storage unit 102 is installed in a desired position by a positioning member 110 of the movable waste liquid storage unit 106.

At the connecting portion between the first absorbent 103 and the second absorbent 105, the protruding portion 108 of the second absorbent 105 contacts and mates with the recessed portion 107 of the first absorbent 103. Since the recessed portion 107 of the first absorbent 103 and the protruding portion 108 of the second absorbent 105 mate with each other, a contact area at the connecting portion can be increased as compared with the case where flat surfaces contact each other without mating. More specifically, a top flat surface 120 and side surface 121 of the protruding portion 108 are in contact with the recessed portion 107. The increase in contact area at the connecting portion improves the efficiency of liquid movement from the first absorbent 103 to the second absorbent 105.

Since the efficiency of liquid movement from the first absorbent 103 to the second absorbent 105 is improved, liquid can be moved from the first absorbent 103 to the second absorbent 105 in no time. Since liquid can be moved from the first absorbent 103 to the second absorbent 105 in no time, contamination of the device and its surroundings by liquid leaking out of the device can be reduced.

The recessed portion 107 of the first absorbent 103 is formed without sticking out from the housing of the fixed waste liquid storage unit 102 and the protruding portion 108 of the second absorbent 105 is also formed without sticking out from the housing of the movable waste liquid storage unit 106. Thus, a user can replace the movable waste liquid storage unit 106 without accidentally touching the absorbents containing liquid.

As the material for the first absorbent 103 and the second absorbent 105, a nonwoven fabric such as felt can be used. The absorbents are selected such that the density of the first absorbent 103≤the density of the second absorbent 105. An absorbent retains liquid between fibers. If an absorbent has a high density, a distance between fibers is short and capillary force acts more strongly than that in an absorbent having a low density. If the capillary force is strong, the force of sucking of liquid also becomes strong and the speed of sucking is improved. Accordingly, liquid can be moved efficiently from the first absorbent 103 to the second absorbent 105 by satisfying the density of the first absorbent 103≤the density of the second absorbent 105.

Figure 3A:
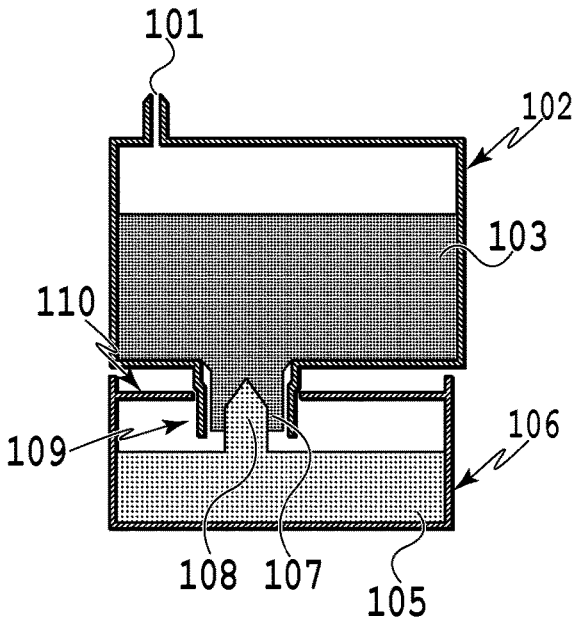
FIG. 3A is a diagram showing a modification of a first embodiment.
Figure 3B:
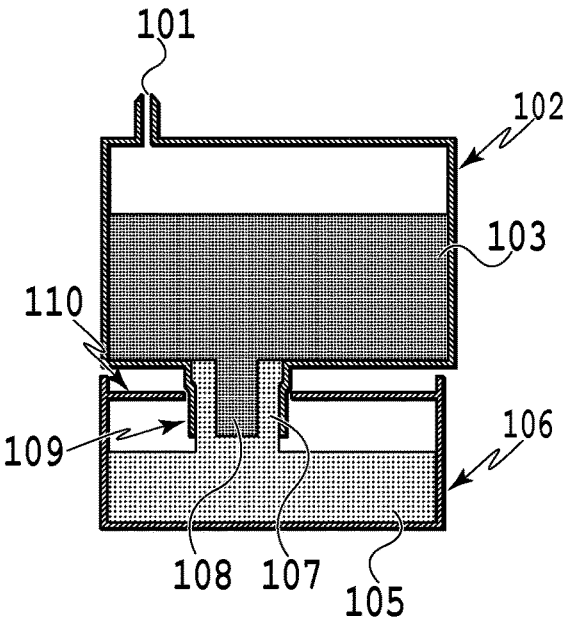
FIG. 3B is a diagram showing a modification of the first embodiment.

FIG. 3A and FIG. 3B show modifications of the present embodiment. As shown in FIG. 3A, the tip of the protruding portion 108 is tapered and the recessed portion 107 which receives the protruding portion 108 is shaped to fit the tip of the protruding portion 108. Since the tip of the protruding portion 108 is tapered (pointed), the protruding portion 108 can be easily inserted into the recessed portion 107 at the time of mating with the recessed portion 107. In addition, since the tip is tapered, the contact area between the first absorbent 103 and the second absorbent 105 can be increased and liquid can be efficiently moved from the first absorbent 103 to the second absorbent 105 as compared with the case where the tip is flat as shown in FIG. 2A and FIG. 2B.

Alternatively, as shown in FIG. 3B, the first absorbent 103 may have a projecting shape and the second absorbent 105 may have a recessed shape such that they mate with each other. Further, the protruding portion of the first absorbent 103 shown in FIG. 3B may be pointed.

As described above, the first absorbent 103 of the fixed waste liquid storage unit 102 and the second absorbent 105 of the movable waste liquid storage unit 106 are connected to each other by mating of the recessed or protruding portion of the first absorbent 103 with the protruding or recessed portion of the second absorbent 105. This enables a smooth flow of liquid and makes it possible to provide a liquid consuming device capable of reducing contamination of the device and its surroundings.

In the present embodiment, the movable waste liquid storage unit 106 is detachably provided in the body of the device and the second absorbent 105 provided therein can be detached and replaced. This configuration is effective especially in a liquid consuming device having a continuous liquid supply system capable of refilling a tank provided in the liquid consuming device with liquid from a refill container such as a bottle. This is because since such a liquid consuming device tends to consume more liquid than a conventional one and discharge more waste liquid accordingly, a large amount of waste liquid can be collected by replacing the second absorbent 105.

Second Embodiment

The second embodiment of the present invention will be described below with reference to the accompanying drawings. Since the basic configuration of the present embodiment is the same as that of the first embodiment, only a characteristic configuration will be described below.

Figure 4B:
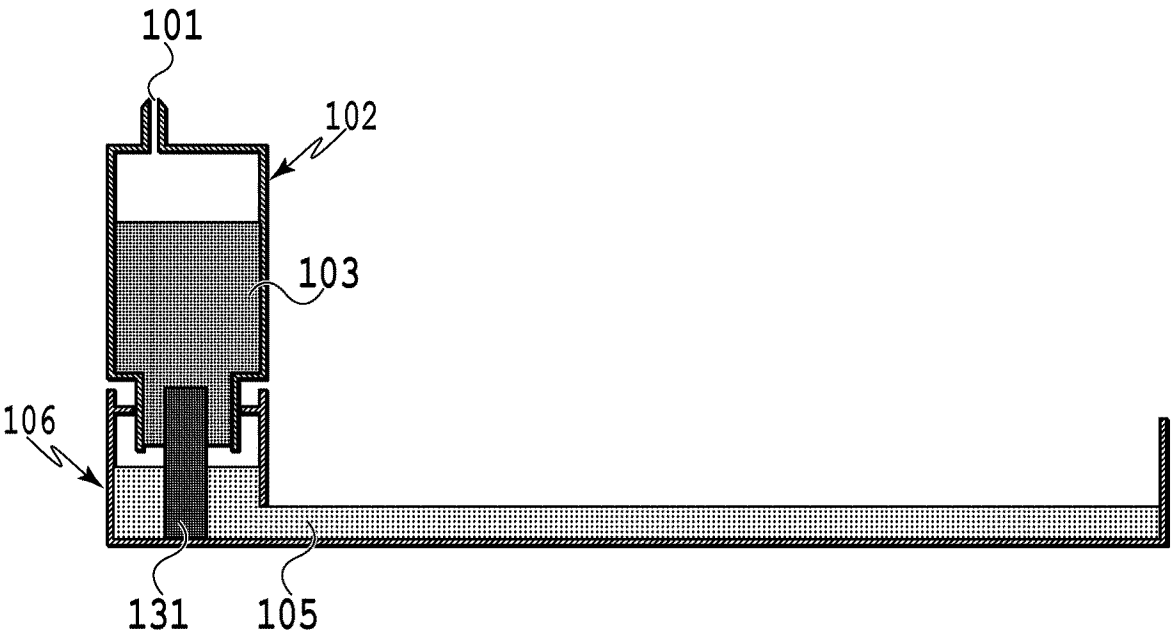
FIG. 4B is a diagram showing the connecting portion between the first absorbent and the second absorbent.
Figure 4A:
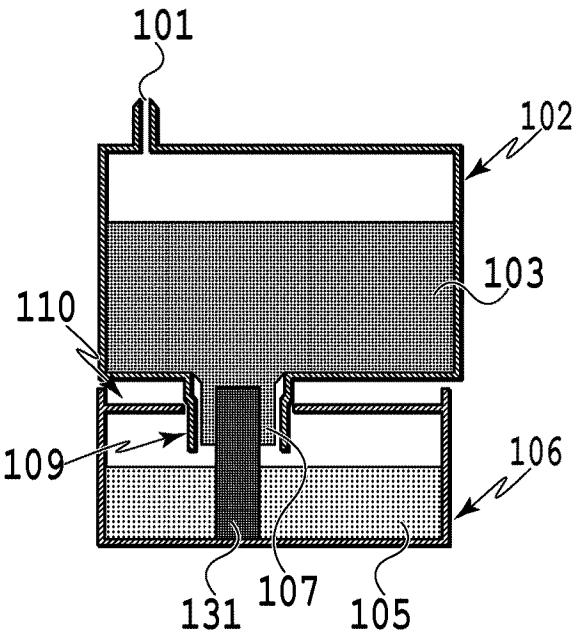
FIG. 4A is a diagram showing the connecting portion between the first absorbent and the second absorbent.

FIG. 4A and FIG. 4B are diagrams showing the connecting portion between the first absorbent 103 and the second absorbent 105 in the present embodiment. FIG. 4A is a side view and FIG. 4B is a front view. In the present embodiment, a third absorbent 131 is provided at the connecting portion between the first absorbent 103 and the second absorbent 105. The first absorbent 103 and the second absorbent 105 are connected to each other via the third absorbent 131.

In the present embodiment, each of the first absorbent 103 and the second absorbent 105 has a recessed portion and the columnar third absorbent 131 is provided in the recessed portion of the first absorbent 103 and the recessed portion of the second absorbent 105. Although the recessed portion of the second absorbent 105 has such a depth as to penetrate the second absorbent 105 in the present embodiment, the recessed portion of the second absorbent 105 is not limited to this and may have a depth not penetrating the second absorbent 105. However, the contact area between the third absorbent 131 and the second absorbent 105 increases with the depth of the recessed portion of the second absorbent 105. The larger the contact area between the second absorbent 105 and the third absorbent 131 is, the more efficiently liquid can be moved from the third absorbent 131 to the second absorbent 105. Thus, it is preferable that the recessed portion provided in the second absorbent 105 have a great depth.

Although the third absorbent 131 is a columnar absorbent having a constant thickness (outside diameter) over its entire length in the present embodiment, the third absorbent 131 is not limited to this. That is, the third absorbent may have an increased thickness (outside diameter) between the first absorbent 103 and the second absorbent 105.

As the material for the first absorbent 103, the second absorbent 105, and the third absorbent 131, a nonwoven fabric such as felt can be used. The absorbents are selected such that the density of the third absorbent 131>the density of the second absorbent 105. Although an increase in density of an absorbent enhances the capillary force and thereby improves the efficiency of liquid movement, the amount of liquid that can be stored decreases as compared with an absorbent having a low density. Thus, it is preferable to select the densities of the absorbents according to the specification of the device in consideration of the balance between the amount of liquid to be stored and the efficiency of liquid movement.

As described above, the first absorbent 103 and the second absorbent 105 are connected to each other via the third absorbent 131 having a density higher than the first absorbent 103 and the second absorbent 105. This enables a smooth flow of liquid and makes it possible to provide a liquid consuming device capable of reducing contamination of the device and its surroundings.

Third Embodiment

The third embodiment of the present invention will be described below with reference to the accompanying drawings. Since the basic configuration of the present embodiment is the same as that of the first embodiment, only a characteristic configuration will be described below.

Figure 5B:
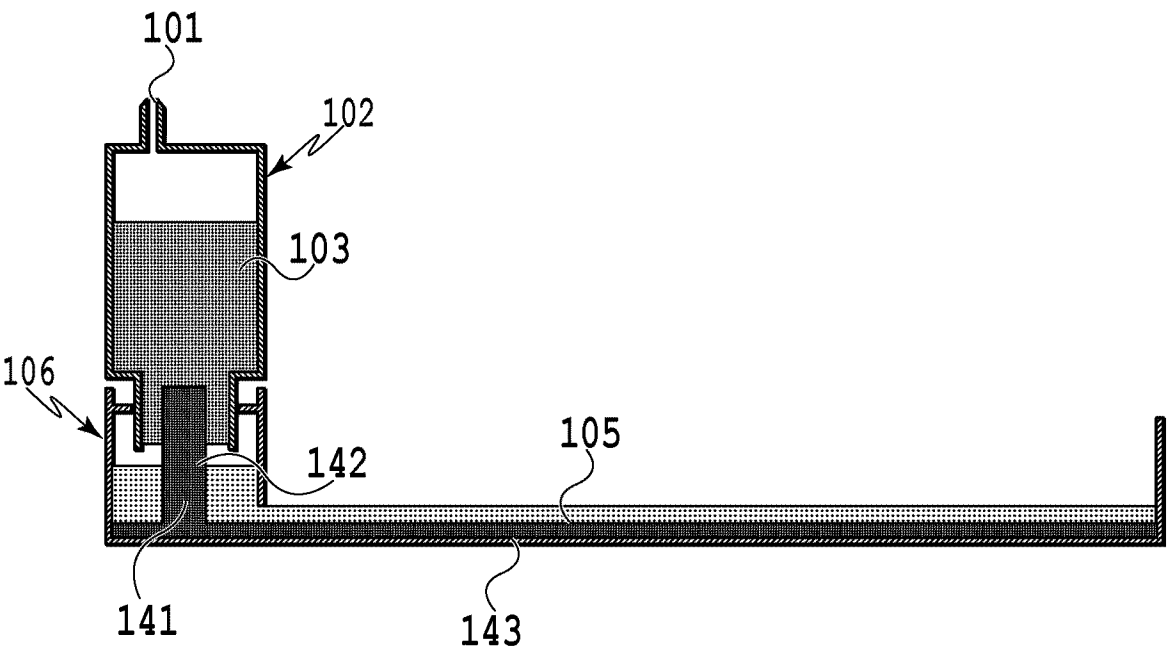
FIG. 5B is a diagram showing the connecting portion between the first absorbent and the second absorbent.
Figure 5A:
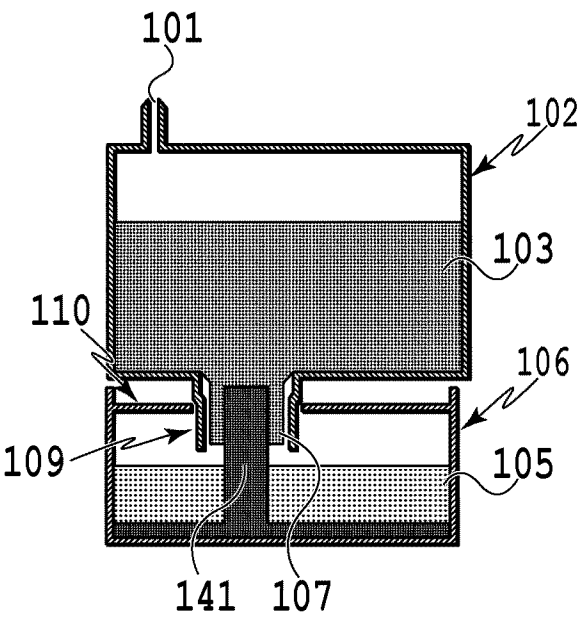
FIG. 5A is a diagram showing the connecting portion between the first absorbent and the second absorbent.

FIG. 5A and FIG. 5B are diagrams showing the connecting portion between the first absorbent 103 and the second absorbent 105 in the present embodiment. FIG. 5A is a side view and FIG. 5B is a front view. In the present embodiment, a third absorbent 141 is provided at the connecting portion between the first absorbent 103 and the second absorbent 105. In this regard, the present embodiment is similar to the second embodiment. However, the present embodiment is different from the second embodiment in that the third absorbent 141 provided at the connecting portion between the first absorbent 103 and the second absorbent 105 extends over the whole bottom surface of the movable waste liquid storage unit 106.

The third absorbent 141 of the present embodiment has an absorbent connecting portion 142 connecting the first absorbent 103 and the second absorbent 105 and a bottom portion 143 extending over the whole bottom surface of the movable waste liquid storage unit 106.

The movable waste liquid storage unit 106 is often located at the bottom of an inkjet printer because of space constraints and has a flat and wide shape. The bottom portion 143 is provided over the whole bottom surface of the movable waste liquid storage unit 106 below the second absorbent 105 and has a density higher than the density of the second absorbent 105. Thus, liquid moved from the first absorbent 103 can be distributed over the whole area of the movable waste liquid storage unit 106. Accordingly, the third absorbent 141 is selected such that the density of the third absorbent 141>the density of the second absorbent 105. As the material for the third absorbent 141, a nonwoven fabric such as felt can be used.

Further, although the third absorbent 141 is provided over the whole bottom surface of the movable waste liquid storage unit 106 in the present embodiment, the third absorbent 141 is not limited to this. That is, the absorbent may be partially cut out in an area of the movable waste liquid storage unit 106 between one end at which the connecting portion is provided and the other end. For example, the absorbent may be partially cut out in a circular shape.

As described above, the third absorbent 141 connecting the first absorbent 103 and the second absorbent 105 has the bottom portion 143 extending along the bottom surface of the movable waste liquid storage unit 106. This enables a smooth flow of liquid and makes it possible to provide a liquid consuming device capable of reducing contamination of the device and its surroundings.

Fourth Embodiment

The fourth embodiment of the present invention will be described below with reference to the accompanying drawings. Since the basic configuration of the present embodiment is the same as that of the first embodiment, only a characteristic configuration will be described below.

Figure 6B:
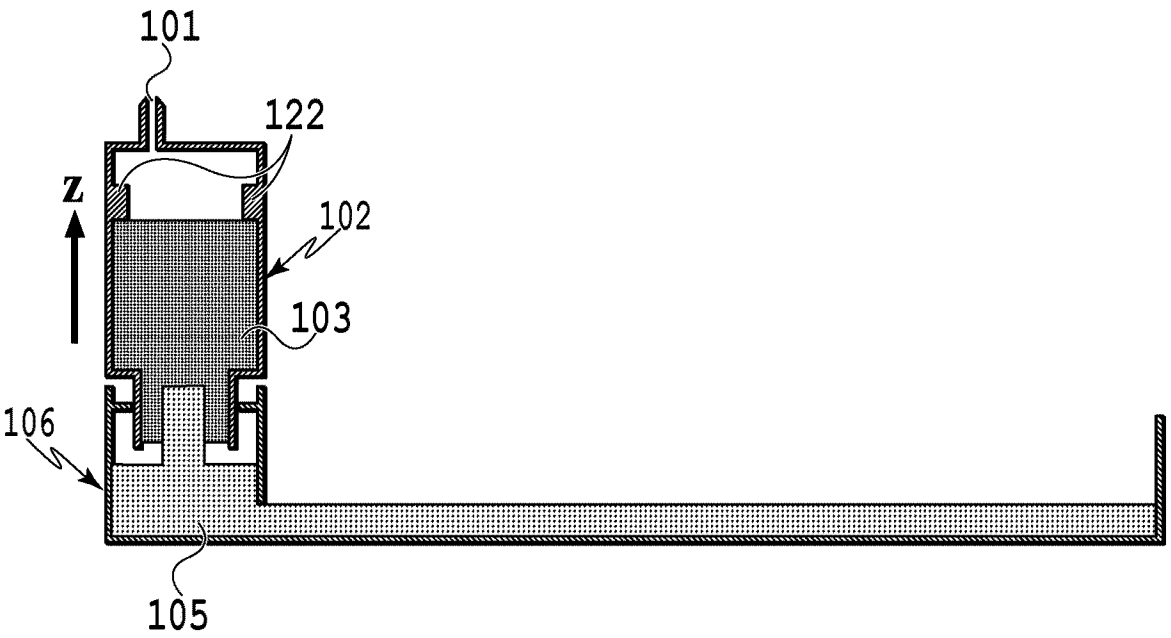
FIG. 6B is a diagram showing the connecting portion between the first absorbent and the second absorbent.
Figure 6A:
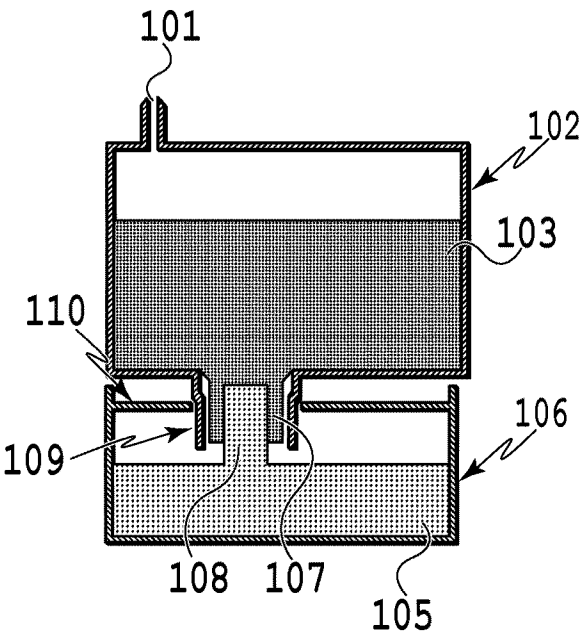
FIG. 6A is a diagram showing the connecting portion between the first absorbent and the second absorbent.

FIG. 6A and FIG. 6B are diagrams showing the connecting portion between the first absorbent 103 and the second absorbent 105 in the present embodiment. FIG. 6A is a side view and FIG. 6B is a front view. In the present embodiment, the configuration of the first absorbent 103 and the second absorbent 105 is the same as that of the first embodiment except that a rib 122 is provided in the fixed waste liquid storage unit 102.

The fixed waste liquid storage unit 102 of the present embodiment is equipped with the rib 122 which regulates the movement of the first absorbent 103. The rib 122 contacts the first absorbent 103 and regulates the movement of the first absorbent 103 in the direction of arrow Z.

In a case where the recessed portion 107 of the first absorbent 103 mates with the protruding portion 108 of the second absorbent 105, there is a possibility that they do not sufficiently mate with each other if the first absorbent 103 escapes in the direction of arrow Z due to friction drag between the first absorbent 103 and the second absorbent 105. In this case, the connection portion may have a non-contact portion between the absorbents, which may inhibit a smooth flow of liquid. Thus, the protruding rib 122 is provided inside the fixed waste liquid storage unit 102 and brought into contact with the first absorbent 103, thereby regulating the movement of the first absorbent 103 in the direction of arrow Z at the time of connecting the first absorbent 103 and the second absorbent 105. As a result, the first absorbent 103 and the second absorbent 105 are securely connected to each other and liquid can flow smoothly.

Although the rib 122 is provided inside the fixed waste liquid storage unit 102 in the present embodiment, the regulating member is not limited to this as long as it regulates the movement of the first absorbent 103 in the direction of arrow Z. For example, a spacer which regulates the movement of the first absorbent 103 in the direction of arrow Z may be provided above the first absorbent 103 in the internal space of the fixed waste liquid storage unit 102.

Alternatively, the escape of the first absorbent 103 in the direction of arrow Z may be regulated by increasing the surface roughness of an inner portion of the fixed waste liquid storage unit 102 in contact with the first absorbent 103 and thereby increasing the contact resistance between the fixed waste liquid storage unit 102 and the first absorbent 103.

As described above, the first absorbent 103 and the second absorbent 105 are connected to each other in the direction of arrow Z by mating and the regulating member which regulates the movement of the first absorbent 103 in the direction of arrow Z is provided inside the fixed waste liquid storage unit 102. This enables a smooth flow of liquid and makes it possible to provide a liquid consuming device capable of reducing contamination of the device and its surroundings.

The embodiments described above may be used in combination with each other as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-020500 filed Feb. 10, 2020, which is hereby incorporated by reference wherein in its entirety.

What is claimed is:

1. A liquid consuming device comprising:

a consuming unit configured to consume liquid; and a storage unit configured to store liquid discharged from the consuming unit, the storage unit comprising a first storage unit comprising a first absorbent therein and a second storage unit comprising a second absorbent therein, the storage unit further comprising a third absorbent connecting the first absorbent and the second absorbent, liquid moving from the first storage unit via the third absorbent to the second storage unit, wherein one end of the third absorbent is connected to a recessed portion provided in the first absorbent, and the other end of the third absorbent is connected to a recessed portion provided in the second absorbent, and wherein in a state in which the liquid consuming device is used, the first absorbent, the third absorbent, and the second absorbent are arranged in this order in a vertical direction from an upper position to a lower position.

2. The liquid consuming device according to claim 1, wherein a density of the first absorbent is less than or equal to a density of the second absorbent.

3. The liquid consuming device according to claim 1, wherein a contact area between the third absorbent and the second absorbent increases with the depth of the recessed portion of the second absorbent.

4. The liquid consuming device according to claim 1, wherein a density of the first absorbent is less than or equal to a density of the second absorbent which is less than a density of the third absorbent.

5. The liquid consuming device according to claim 1, wherein the third absorbent has a columnar shape.

6. The liquid consuming device according to claim 1, wherein the third absorbent comprises an absorbent connecting portion connecting the first absorbent and the second absorbent and a bottom portion extending along a bottom surface of the second storage unit.

7. The liquid consuming device according to claim 6, wherein the bottom portion is provided over the whole bottom surface of the second storage unit.

8. The liquid consuming device according to claim 1, wherein the first storage unit comprises a regulating portion which regulates movement of the first absorbent at a time of connecting to the first absorbent.

9. The liquid consuming device according to claim 8, wherein the regulating portion is a rib in contact with the first absorbent.

10. The liquid consuming device according to claim 1, wherein the first absorbent and the second absorbent are formed of a nonwoven fabric.

11. The liquid consuming device according to claim 1, wherein the third absorbent is formed of a nonwoven fabric.

12. The liquid consuming device according to claim 1, wherein the first storage unit is fixed to a body of the liquid consuming device and the second storage unit is attachable to and detachable from the body of the liquid consuming device.

* * * * *